US007823544B2

(12) United States Patent
Christie

(10) Patent No.: US 7,823,544 B2
(45) Date of Patent: Nov. 2, 2010

(54) STEAM BOILER

(75) Inventor: David M. Christie, Freeville, NY (US)

(73) Assignee: ECR International, Inc., Utica, NY (US)

( * ) Notice: Subject to any disclaimer, the term of this patent is extended or adjusted under 35 U.S.C. 154(b) by 345 days.

(21) Appl. No.: 12/006,707

(22) Filed: Jan. 4, 2008

(65) Prior Publication Data

US 2009/0173292 A1 Jul. 9, 2009

(51) Int. Cl.
*F28F 19/00* (2006.01)
*F22B 1/26* (2006.01)

(52) U.S. Cl. ..... 122/32; 122/18.1; 165/134.1

(58) Field of Classification Search ..... 122/18.1, 122/31.1, 32, 40, 41; 165/134.1
See application file for complete search history.

(56) References Cited

U.S. PATENT DOCUMENTS 3,850,146 A 11/1974 Graham et al.
4,222,350 A 9/1980 Pompei et al.
4,356,794 A * 11/1982 Bouman et al. ..... 122/158
4,499,859 A 2/1985 Nishiguchi et al.
4,793,800 A 12/1988 Vallett et al.
5,259,343 A 11/1993 Cone, II et al.
5,365,888 A 11/1994 Aronov
5,473,884 A * 12/1995 Sutton et al. ..... 60/39.182
5,485,879 A 1/1996 Lannes
5,626,187 A * 5/1997 Nilsson ..... 165/134.1
5,809,913 A 9/1998 Kramer et al.
6,076,518 A * 6/2000 Klouda et al. ..... 126/391.1
6,082,444 A 7/2000 Harada et al.
6,604,572 B2 8/2003 Kawamoto

* cited by examiner

*Primary Examiner*—Gregory A Wilson
(74) *Attorney, Agent, or Firm*—Phillips Lytle LLP

(57) ABSTRACT

A steam boiler (15) comprising a fuel burning device (16) disposed in a combustion chamber and adapted to burn a fuel to form combustion gases (19), a passage (30) extending between a water inlet (20) and a steam outlet (23), the passage having a water space (31) and a steam space (32), a flue passage (33) extending between the combustion chamber and a flue outlet (24) and having a gas heat transfer space (34), a heat exchange element (43) between the gas heat transfer space and the water and steam spaces, the heat exchange element having a gas-side surface (35) that absorbs heat from the combustion gases and an opposed water-side surface (38) that radiates heat, the water-side surface having a first portion (39) adjacent to the water space and a second portion (40) adjacent to the steam space, the gas-side surface having a first portion (36) opposite the water-side first portion and a second portion (37) opposite the water-side second portion, the water-side first portion having a surface area and the water side second portion having a surface area, the gas-side first portion having a surface area and the gas-side second portion having a surface area, and a heat shield (41, 42, 45, 48) covering at least some of the surface area of the gas-side second portion. The surface area of the gas-side first portion may be greater than the surface area of the water-side first portion and the surface area of the gas-side second portion may be less than or approximately equal to the surface area of the water-side second portion.

17 Claims, 9 Drawing Sheets

STEAM BOILER

TECHNICAL FIELD

The present invention relates generally to the field of steam boilers, and more particularly to a corrosive resistant steam boiler.

BACKGROUND ART

Steam boilers are well-known in the prior art and have been used in residential heating applications for years. Most steam boiler systems known in the prior art include a boiler connected to radiators by a pipe system. The pipe system allows steam to rise into the radiators, pushing the ambient air out of the radiators, until a steam vent valve on the radiator closes due to the temperature rise. The steam then condenses against the inside surface of the radiator and trickles back to the boiler by gravity through the same pipe system. Thus, most steam heating systems are open systems that are filled with air during the off cycle. The air is forced out the system when the boiler is steaming. At the end of a call for heat, the steam field collapses and draws air back into the system.

Generally, residential steam boilers are constructed of cast iron with vertical flue passages or flue ways. These vertical flue ways pass through a steam collection volume, sometimes referred to as a steam chest or steam space. The boiler is filled with water to a defined water level inside the casting. The casting acts as a heat exchange unit and a heat source is used to heat the water inside the boiler. Steam then collects above the waterline in the steam space before exiting up through the pipe system to the radiators. Occasionally, water must be added to the boiler because of intended and unintended losses. Intended losses may include loss e of water to flush or blow down the mechanical float water level control, loss e of water to flush or blow down sediment from the bottom of the boiler, and loss e of water due to the escape of steam through the vent valves. Unintended losses may include leaking radiator vents and leaking in the pipe system.

However, prior art boilers tend to corrode or degrade over time and with use. Thus, it would be beneficial to provide a boiler which is more resistant to the corrosive effect of heat and impurities in the system.

DISCLOSURE OF THE INVENTION

With parenthetical reference to the corresponding parts portions or surfaces of the disclosed embodiment, merely for purposes of illustration and not by way of limitation, the present invention broadly provides a steam boiler (15) comprising a fuel burning device (16) disposed in a combustion chamber (52) and adapted to burn a fuel to form combustion gases (19), a passage (30*a-d*) extending between a water inlet (20*a-d*) and a steam outlet (22*a-b*the passage having a water space (31*a-d*) and a steam space (32*a-d*), a flue passage (33*a-c*) extending between the combustion chamber and a flue outlet (24) and having a gas heat transfer space (34*a-c*), a heat exchange element (43*a-f*) between the gas heat transfer space and the water and steam spaces, the heat exchange element having a gas-side surface (35*a-f*) that absorbs heat from the combustion gases and an opposed water-side surface (38*b-g*) that radiates heat, the water-side surface having a first portion (39*a-f*) adjacent to the water space and a second portion (40*a-f*) adjacent to the steam space, the gas-side surface having a first portion (36*a-f*) opposite the water-side first portion and a second portion (37*a-f*) opposite the water-side second portion, the water-side first portion having a surface area and the water side second portion having a surface area, the gas-side first portion having a surface area and the gas-side second portion having a surface area, and a heat shield (41*a-d,* 42*a-d,* 45, 48) covering at least some of the surface area of the gas-side second portion.

The heat shield (41) may cover all of the surface area of the gas-side second portion and the heat shield (42, 45, 48) may cover some of the surface area of the gas-side first portion. The surface area of the gas-side second portion may be less than or approximately equal to the surface area of the water-side second portion. The surface area of the gas-side first portion may be greater than the surface area of the water-side first portion. The surface area of the gas-side second portion may be greater than the surface area of the water-side second portion and the surface area of the gas-side first portion may be greater than the surface area of the water-side first portion. The gas-side first portion may comprise a pin deck (44). The heat exchange element may comprise a cast iron section (26-29) having an interior volume and the interior volume may comprise the water space and the steam space. The heat exchange element may comprise a first cast iron section (26) connected to a second cast iron section (27), the first cast iron section and the second cast iron section may form a volume (34*a*) there between, and the volume may comprise the gas heat transfer space. The first cast iron section may have an interior volume and the interior volume may comprise the water space (31*a*) and the steam space (32*a*). The second cast iron section may have an interior volume and the interior volume of the second cast iron section may comprise a second water space (31*b*) and a second steam space (32*b*). The heat shield (45) may comprise a metal plate (46) covering at least some of the surface area of the gas-side second portion (37), and an air space (47) between the metal plate and at least some of the surface area of the gas-side second portion. The heat shield (48) may comprise an insulation layer (49) bonded to at least some of the surface area of the gas-side second portion. The heat exchange element may have a ratio between the surface area of the gas-side first portion and the surface area of the water-side first portion of greater than one, and the heat exchange element may have a ratio between the surface area of the gas-side second portion and the surface area of the water-side second portion that is less than the ratio between the surface area of the gas-side first portion and the surface area of the water-side first portion.

In another aspect, a heat exchanger is provided comprising a first passage extending between a water inlet and a steam outlet, the first passage having a water space and a steam space, a second passage extending between a fluid or gas inlet and a fluid or gas outlet, the second passage having a heat transfer space, a heat exchange element between the heat transfer space and the water and steam spaces, the heat exchange element having a gas-side surface adapted to absorb heat from the heat transfer space and an opposed water-side surface adapted to radiate heat, the water-side surface having a first portion adjacent to the water space and a second portion adjacent to the steam space, the gas-side surface having a first portion opposite the water-side first portion and a second portion opposite the water-side second portion, the water-side first portion having a surface area and the water side second portion having a surface area, the gas-side first portion having a surface area and the gas-side second portion having a surface area, and a heat shield covering at least some of the surface area of the gas-side second portion.

Accordingly, the general object of the present invention is to provide an improved steam boiler that is resistant to corrosion. These and other objections and advantages will become apparent from the foregoing and ongoing written specifications, the drawings, and the appended claims.

DESCRIPTION OF THE PREFERRED EMBODIMENTS

Figure 1:
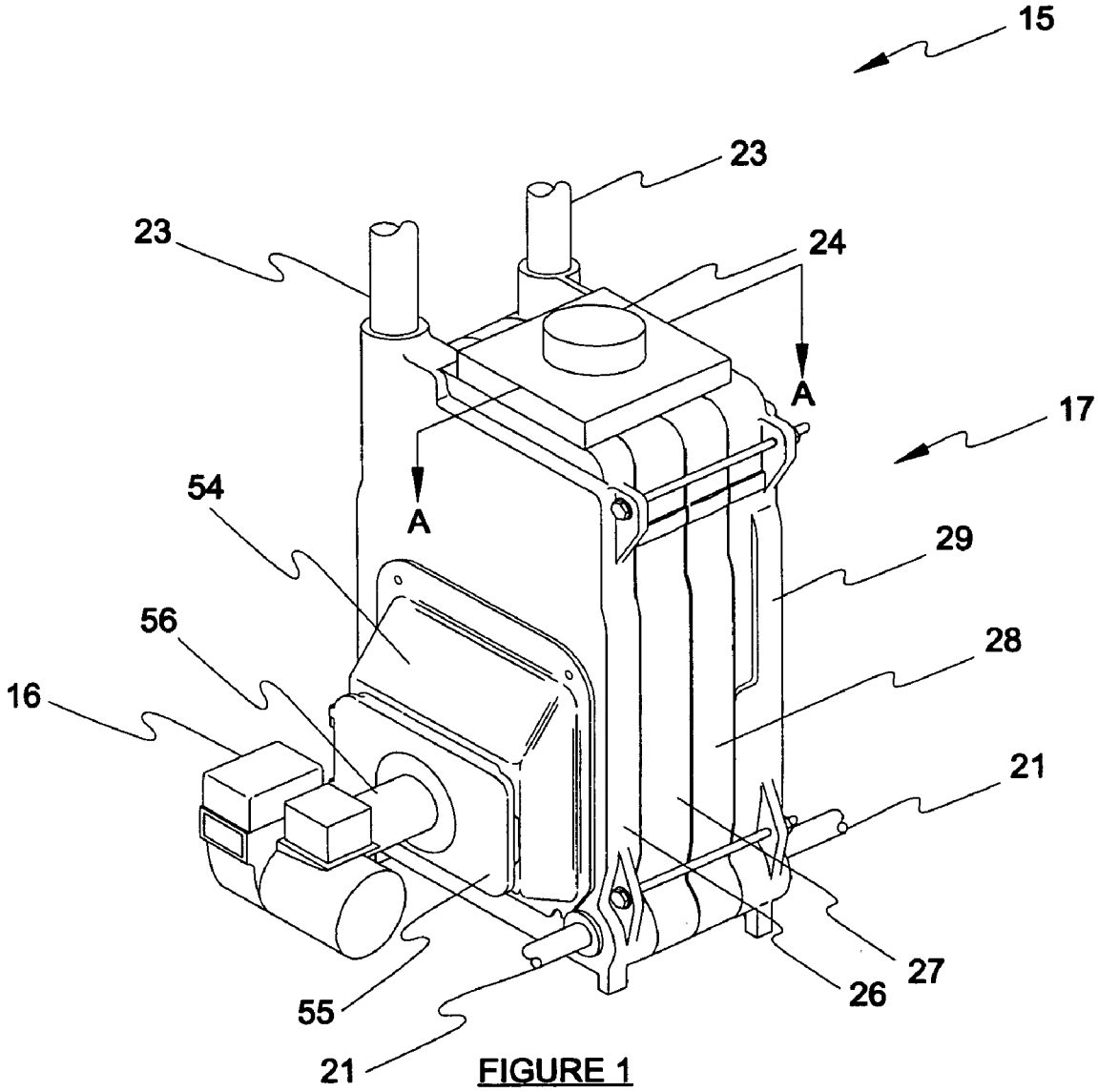
FIG. 1 is a perspective view of the preferred embodiment of the improved steam boiler.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
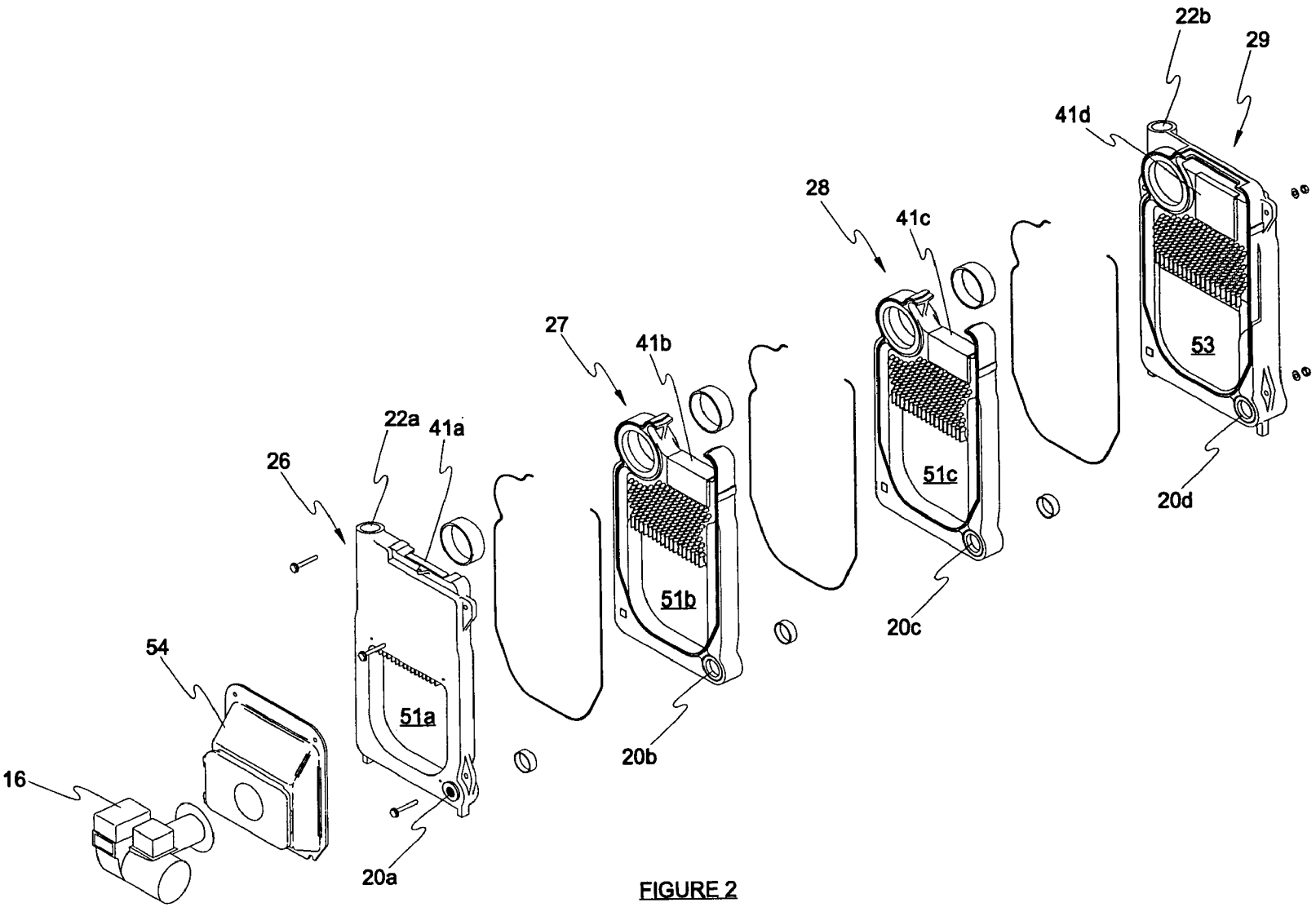
FIG. 2 is an exploded view of the steam boiler shown in FIG. 1.

Referring now to the drawings, and more particularly to FIGS. 1 and 2 thereof, this invention provides an improved steam boiler, of which the presently preferred embodiment is generally indicated at 15. Boiler 15 generally includes a conventional burner 16 connected to a cast iron heat exchanger 17. Heat exchanger 17 is connected to a water source by pipes 21, through which a desired water level for the interior volume of heat exchanger 17 is provided. Heat exchanger 17 is also connected to pipes 23, which are part of a pipe system between heat exchanger 17 and peripheral radiators. Heat exchanger 17 includes a combustion gas outlet vent 24 at the top.

Figure 3:
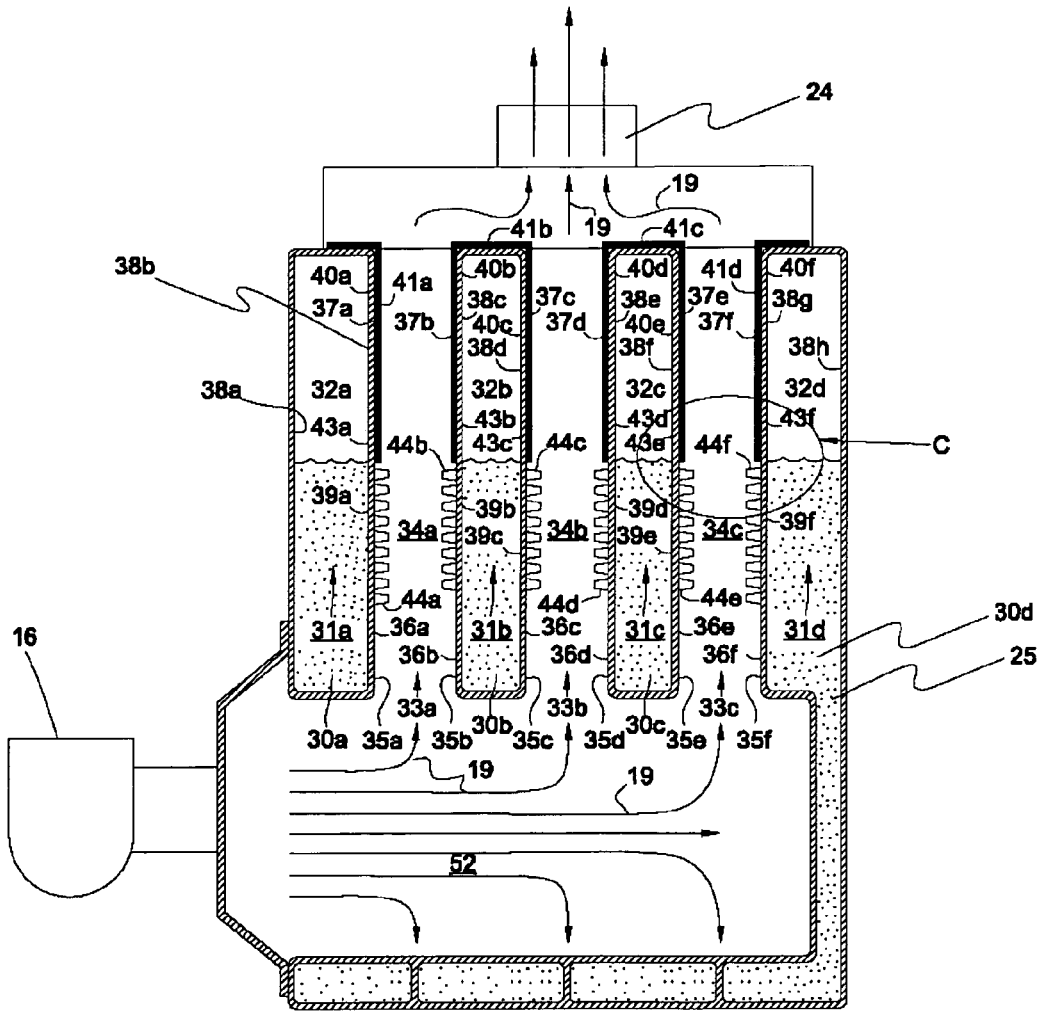
FIG. 3 is a vertical sectional view of the steam boiler shown in FIG. 1, taken generally on line A-A of FIG. 1.

As shown in FIGS. 2-3, heat exchanger 17 is formed from four castings, a front casting 26, a first center casting 27, a second center casting 28, and a rear casting 29. Rear casting 29 has a recessed lower portion 53 and each of front casting 26 and center castings 27 and 28 include openings 51*a-c*. Front casting 26 is connected to burner 16 by a burner tube 56 and a combustion chamber connector 54, which includes a hinged door 55 that provides access to the interior volume of heat exchanger 17, thereby forming a combustion chamber 52 for forming combustion gases 19. Opening 51*a* allows for open communication and passage from burner 16 through burner tube 56 and connector 54 into combustion chamber 52.

Castings 26-29 are joined with tie rods extending between front casting 26 and rear casting 29, such that openings 51*a*-51*c* and recess 53 form combustion chamber 52. The castings are also configured such that a vertically extending flue passage 33*a* is provided between adjacent castings 26 and 27, a vertically extending flue passage 33*b* is provided between castings 27 and 28, and a vertically extending flue passage 33*c* is provided between castings 28 and 29, respectively. These flue passages communicate between combustion chamber 52 and flue gas exhaust outlet 24. Vertically extending flue ways 33*a*-33*c* are defined by outer opposed vertical surfaces 35*a* and 35*b*, outer opposed vertical surfaces 35*c* and 35*d*, and outer opposed vertical surfaces 35*e* and 35*f*, respectively, of castings 26-29. These passages provide a heat transfer space 34.

Castings 26-29 have an upper hollow region that defines vertical passages 30*a*-30*d*, respectively. Passages 30*a*-30*d* allow for water and steam to communicate between water inlets 20*a*-20*d* and steam outlets 22*a*-22*d*, respectively. Vertically extending passages 30*a*-30*d* are defined by vertical inner surfaces 38*a* and 38*b*, vertical inner surfaces 38*c* and 38*d*, vertical inner surfaces 38*e* and 38*f*, and vertical inner surfaces 38*g* and 38*h*, respectively, of castings 26-29.

Figure 4:
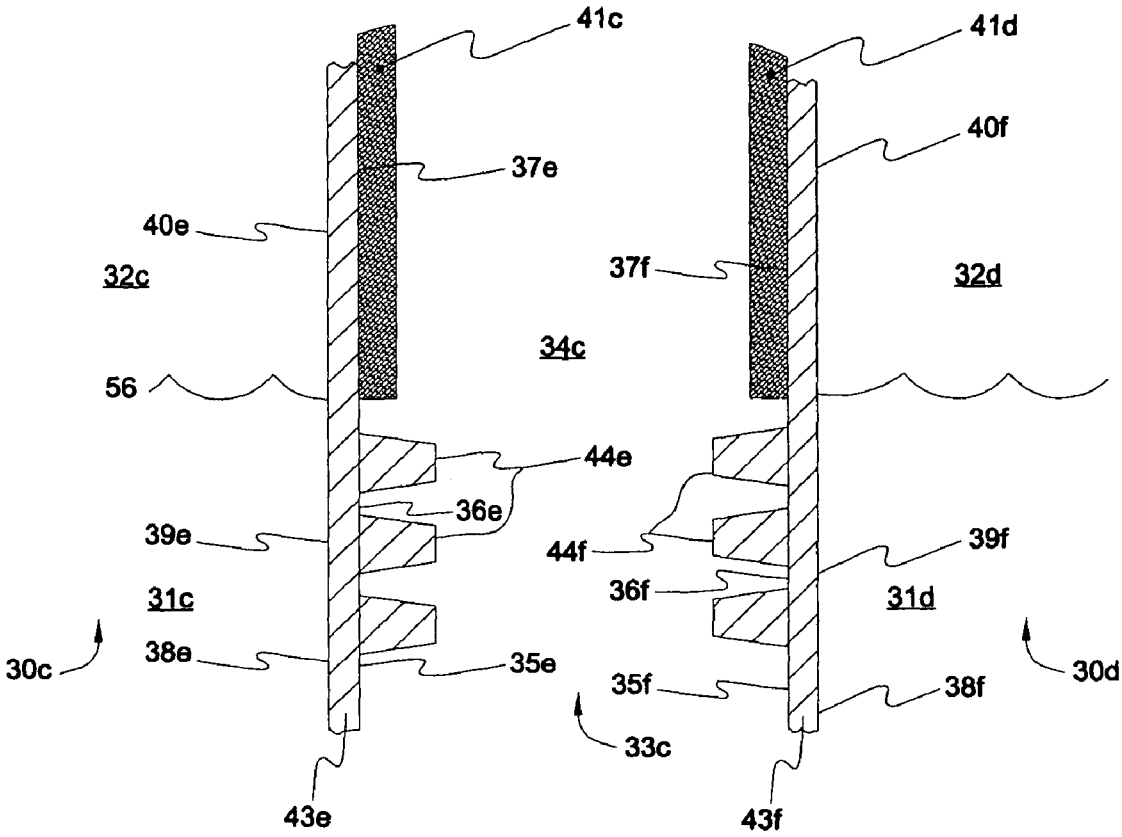
FIG. 4 is an enlarged detailed view of the cross-section shown in FIG. 3, taken within the indicated circle C of FIG. 3.

As shown in FIGS. 3-4, passages 30*a*-30*d* are partially filled with water 25 to a waterline 56. Passages 30*a*-30*d* have a lower water space 31(*a-d*) and an upper steam space 32(*a-d*). Water space 31(*a-d*) is generally filled with water 25. Steam space 32(*a-d*) is a volume in which steam forms before exiting. Therefore, the two inner water side surfaces 38(*a-h*) of each casting each comprise a first lower portion 39(*a-f*) adjacent to water space 31(*a-d*) and a second upper portion 40(*a-f*) adjacent to steam space 32(*a-d*). Each of these portions has in turn a certain surface area. In the preferred embodiment, water side surface 38(*a-h*) is a vertically extending flat planar surface.

The portion of the casting between passage 30(*a-d*) and flue passage 33(*a-c*) acts as a heat exchange wall 43(*a-f*). Walls 43*a*-42*f* of castings 26-29, respectively, allow for the transfer of heat from combustion gases 19, which pass through flue passages 33*a*-33*c*, to water 25 in passages 30*a*-30*d*, thereby heating water 25 to form steam that will pass from outlets 22 to a pipe system 23 and peripheral radiators, thereby heating the radiators and providing radiated heat to a residence or other facility. Wall 43(*a-f*) has two opposed outer surfaces, namely water side surface 38(*b-g*) and gas side surface 35(*a-f*).

Gas side surface 35(*a-f*) has a lower portion 36(*a-f*) opposite lower portion 39(*a-f*) of water side surface 38(*b-g*) and an upper portion 37(*a-f*) opposite upper portion 40(*a-f*) of water side surface 38(*b-g*). Each of these portions has in turn a certain surface area.

In the preferred embodiment, lower portion 36(*a-f*) of gas side surface 35(*a-f*) is provided with a conventional pin deck 44(*a-f*), while upper portion 37(*a-f*) of gas side surface 35(*a-f*) does not include a pin deck. Instead, upper portion 37(*a-f*) is a flat vertical planar surface. As a result, the enhanced outer surface area of lower portion 36(*a-f*) is greater than the flat outer surface area of upper portion 37(*a-f*). Because inner water side surface 38(*b-g*) is a flat vertical planar surface on both its lower portion 39(*a-f*) and its upper portion 40(*a-f*), the surface area of lower portion 36(*a-f*) of gas side surface 35(*a-f*) is substantially greater than the surface area of lower portion 39(*a-f*) of water side surface 38(*b-g*). However, the surface area of upper portion 37(*a-f*) of gas side surface 35(*a-f*) is substantially the same as the surface area of upper portion 40(*a-f*) of water side 38(*b-g*). As a result, greater heat transfer across wall 43(*a-f*) will occur from lower portion 36(*a-f*) of gas side surface 35(*a-f*) to lower portion 39(*a-f*) of water side surface 38(*b-g*) relative to heat transfer between upper portion 37(*a-f*) of gas side surface 35(*a-f*) and upper portion 40(*a-f*) of water side surface 38(*b-g*). As a result, water spaces 31*a*-31*d* of passages 30*a*-30*d* will receive greater emitted heat from walls 43*a*-43*f*, while steam spaces 32*a*-32*d* of passages 30*a*-30*d* will not be heated to as great an extent as water spaces 31*a*-31*d*. Thus the heat transfer is focused from combustion gases 19 to water 25 in water space 31(*a-d*).

Heat transfer across wall 43(*a-f*) is further limited by a heat shield 41(*a-d*) covering upper portion 37(*a-f*) of gas side surface 35(*a-f*). Heat shield 41(*a-d*) decreases heat transfer from combustion gases 19 in heat transfer space 34(*a-c*) to upper portion 40(*a-f*) of water side surface 38(*b-g*) g) of heat exchange wall 43(*a-f*). In the preferred embodiment, heat shield 41(*a-d*) is a metal plate that extends over and covers all of upper portion 37(*a-f*) of gas side surface 35(*a-f*). As shown, shield 41*a* comprises a horizontal plate connected at its right edge to the top edge of a vertical plate. The vertical plate covers upper portion 37*a* of gas side surface 35*a*, and the horizontal plate extends over and is supported by the top of front casting 26. This same form is employed with respect to shield 41*d* on rear casting 29. A vertical plate covers upper portion 37*f* of gas side surface 35*f*, and is connected at its top edge to the left edge of a horizontal plate that extends over and is supported by the top of rear casting 29. Shields 41*b* and 41*c* comprise two vertically extending plates connected at their top edges by a horizontal support plate. Shield 41*b* saddles the top of casting 27 such that the first vertical plate covers upper portion 37*b* of gas side surface 35*b* and the second vertical plate covers upper portion 37*c* of gas side surface 35*c*. Shield 41*c* saddles the top of casting 28 such that the first vertical plate covers upper portion 37*d* of gas side surface 35*d* and the second vertical plate covers upper portion 37*e* of gas side surface 35*e*. Thus, the upper portion 37(*a-f*) of gas side surface 35(*a-f*) does not include a pin deck 44(*a-f*) and instead is covered by heat shield 41(*a-d*).

A number of unexpected benefits result from the variation in surface area between upper portion 37(*a-f*) and lower portion 36(*a-f*) of gas side surface 35(*a-f*) and the placement of heat shield 41(*a-d*) over the upper portion 37(*a-f*) of gas side surface 35(*a-f*). Prior art boilers have been known to experience early corrosion to the upper portion 40(*a-f*) of water side surface 38(*a-h*). One of the unexpected benefits of the improved design is that it results in less degradation, in comparison to a conventional steam boiler, to upper portion 40(*a-f*) of water side surface 38(*a-h*). Prior art boilers have also been known to experience excessive amounts of scale build up from calcium and magnesium carbonates on upper portion 40(*a-f*) of water side surface 38(*a-h*). This scale build up is reduced with the improved design. Thus, counter intuitively and unexpectedly, covering upper portion 37(*a-f*) of gas side surface 35(*a-f*) with shield 41(*a-d*), rather than covering the upper portion 40(*a-f*) of water side surface 38(*a-h*) where corrosion was typically found in the prior art, reduced the corrosive effects of temperature and contaminants on water side surface 38(*a-h*). This was found to be particularly beneficial with respect to rear casting 29.

Figure 5:
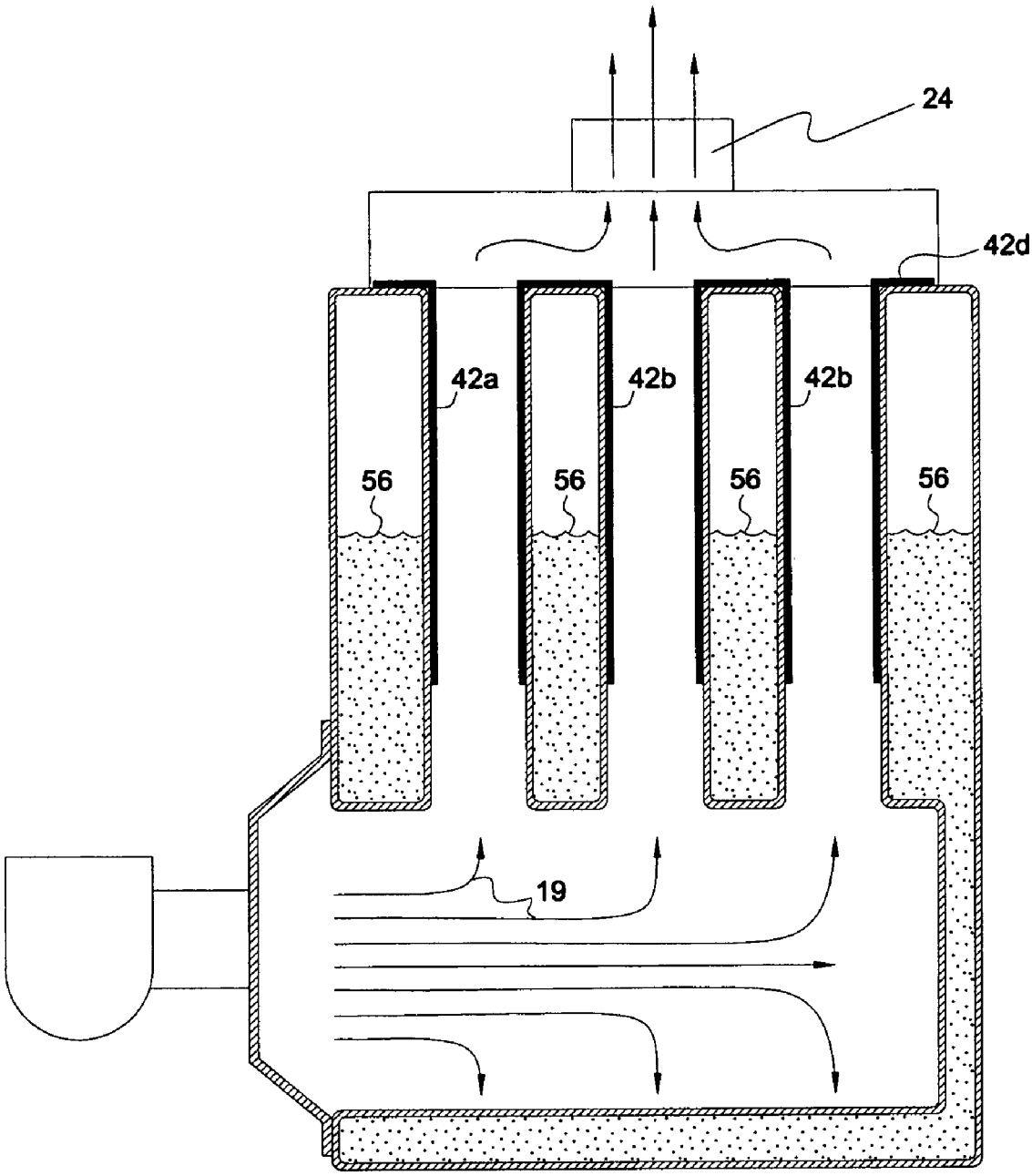
FIG. 5 is a vertical cross-sectional view of an alternative embodiment of the heat transfer walls and heat shields shown in FIG. 3.

FIG. 5 shows an alternative embodiment of heat exchange walls 43*a*-43*f* and heat shields 41*a*-41*d*. In the alternative embodiment shown in FIG. 5, water side surfaces 38*b*-38*g* and passages 30*a*-30*d* are generally the same as the embodiment shown in FIG. 3. However, heat shield 41(*a-d*) and gas side surface 35(*a-f*) have been modified. First, pin deck 44(*a-f*) on lower portion 36(*a-f*) of gas side surface 35(*a-f*) has been removed. Thus, all of gas side surface 35(*a-f*) is a flat vertical planar surface, and the surface area of lower portion 36(*a-f*) is generally the same as the surface area of upper portion 37(*a-f*). Second, an alternative heat shield 42(*a-d*) is used. Heat shield 42(*a-d*) covers not only the upper portion 37(*a-f*) of gas side surface 35(*a-f*) but also some of lower portion 36(*a-f*) of gas side surface 35(*a-f*). The vertical plates of the heat shield shown in FIG. 3 have been lengthened so that they extend below the waterline level 56 in passages 30*a*-30*d* and thereby cover at least some of lower portion 36(*a-f*) of gas side surface 35(*a-f*).

Figure 6:
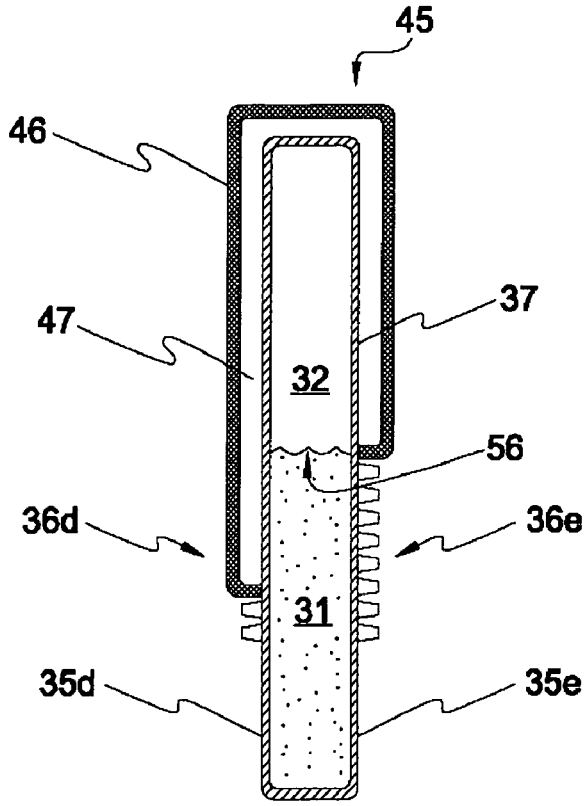
FIG. 6 is a vertical cross-sectional view of a second alternative embodiment of a heat transfer wall and heat shield.
Figure 7:
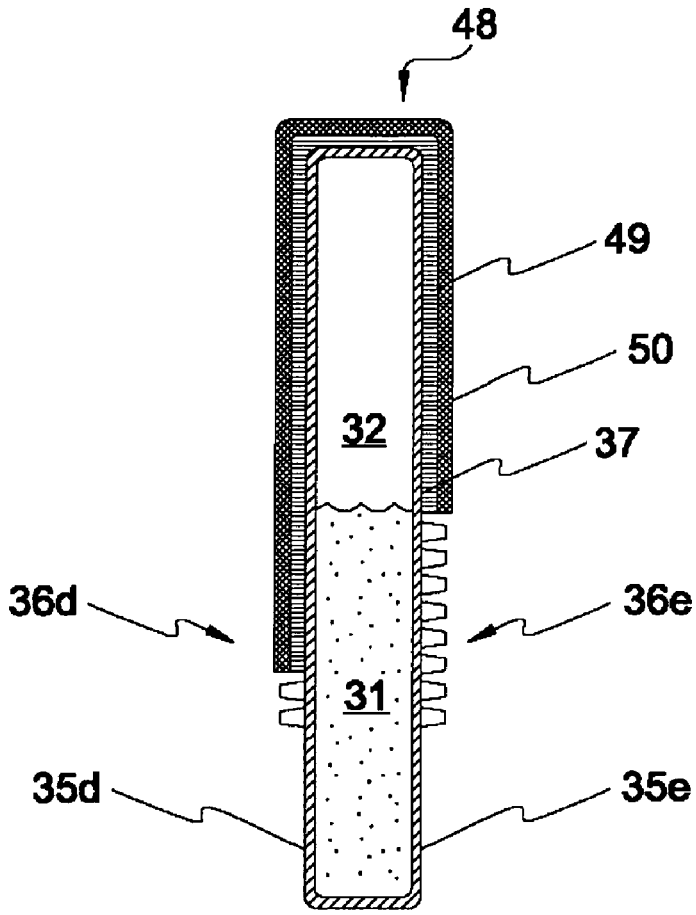
FIG. 7 is a vertical cross-sectional view of a third alternative embodiment of a heat transfer wall and heat shield.

Two additional embodiments of heat exchange wall 43(*a-f*) and heat shield 41(*a-d*) are shown in FIGS. 6 and 7. In the alternative embodiment shown in FIG. 6, water side surface 38(*a-h*) and passage 30*a-d*) are generally the same as the embodiment shown in FIGS. 3 and 5. However, heat shield 41(*c*) and the left gas side surface have been modified. First, a portion of the pin deck 44(*d*) on lower portion 36(*d*) of the left gas side surface 35(*d*) has been removed. Thus, the upper part of lower portion 36(*d*) of the left gas side surface 35(*d*) is a flat vertical planar surface. Second, alternative heat shield 45 is used. Heat shield 45 comprises a metal shielding portion 46 that is adapted to cover the upper gas side surfaces by extending from a point midway up the lower portion 36(*d*) of the left gas side surface 35(*d*), over the top of the casting, and down to the waterline level 56 on the right gas side surface 35(*e*). Shielding portion 46 is also configured to provide an air space 47 between the inner surface of shielding portion 46 and the subject outer surface of the casting. This air space acts as an insulator.

FIG. 7 shows a third embodiment of heat exchange wall 43(*a-f*) and heat shield 41(*a-d*). In the alternative embodiment shown in FIG. 7, water side surface 38(*a-h*) and passages 30*a*-30*d* are generally the same as the embodiments shown in FIGS. 3, 5 and 6. In addition, the left gas side surface 35(*d*) is generally the same as the embodiment shown and described in FIG. 6. However, alternative heat shield 48 is used. Heat shield 48 comprises an outer metal shielding portion 50 that is adapted to cover the upper gas side surfaces by extending from a point midway up the lower portion 36(*d*) of the left gas side surface 35(*d*), over the top of the casting, and down to the waterline level 56 on the right gas side surface 35(*e*), as with the embodiment shown in FIG. 6. However, rather then an air pocket, an insulation layer 49 is provided between shielding portion 50 and the subject outer surface of the casting.

While the preferred embodiments show multiple passages 30*a*-30*d* and multiple flue ways 33*a*-33*c* there between, with multiple separating heat exchange walls 43*a*-43*f*, it is contemplated that only a single heat exchange wall with the improved features may be used, or the number of heat exchange walls with the improved features may be otherwise varied as desired. Also, in a boiler with multiple heat exchange walls 43*a*-43*f*, different embodiments of the heat shield may be used on the different gas side surfaces of the heat exchange walls 43*a*-43*f* employed. Thus, the heat shield used may vary among the multiple heat exchange walls 43*a*-43*f* within the boiler or even between the two gas side surfaces of a particular casting.

Similarly, it is contemplated that the relative surface area of the upper portions and lower portions of the gas side surfaces 35*a*-35*f* may be modified. Thus, the surface area of the gas side upper portion 37(*a-f*) may be less than or approximately equal to the surface area of the water side upper portion 40(*a-f*), the surface area of the gas side lower portion 36(*a-f*) may be greater than the surface area of the water side lower portion 39(*a-f*), or the surface area of the gas side upper portion 37(*a-f*) may be greater than the surface area of the water side upper portion 40(*a-f*) and the surface area of the gas side lower portion 36(*a-f*) may be greater than the surface area of the water side lower portion 39(*a-f*). The differences in surface areas may also vary among the multiple heat exchange walls 43*a*-43*f* within the boiler or in a boiler casting (as each of center castings 27 and 28 in the preferred embodiment have two heat exchange walls 43*b*, 43*c* and 43*d*, 43*e*, respectively).

Figure 8:
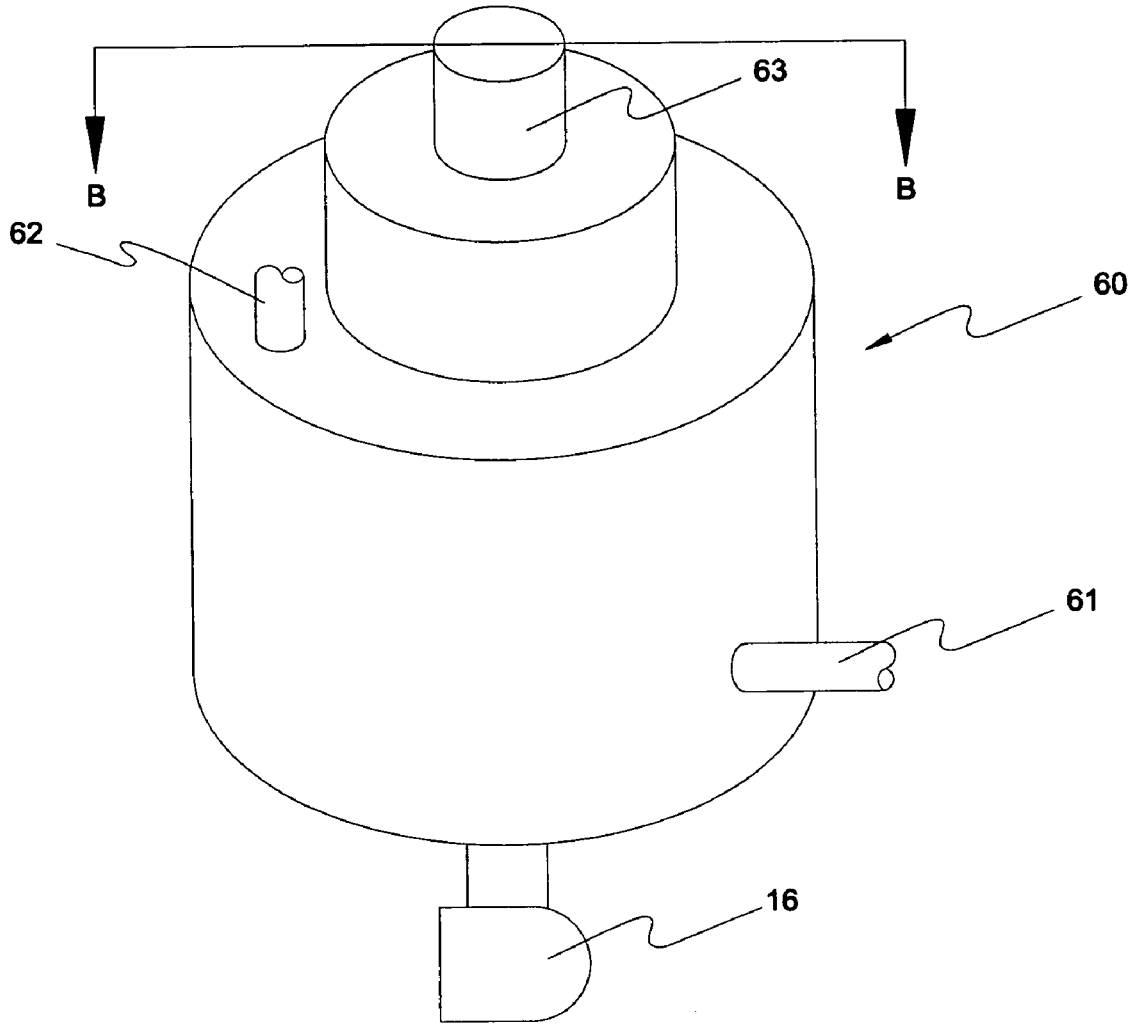
FIG. 8 is a perspective view of an alternative embodiment of the steam boiler shown in FIG. 1.

FIG. 8 shows an alternative embodiment of the cast iron heat exchanger 17 shown in FIG. 1. In this embodiment, a circular vertical tube type boiler or heat exchanger 60 is employed. Boiler 60 is of a welded steel construction having a number of vertical tubes. As shown, heat exchanger 60 includes a single inlet 61 for water and a single outlet 62 for steam together with a flue gas vent 63.

Figure 9:
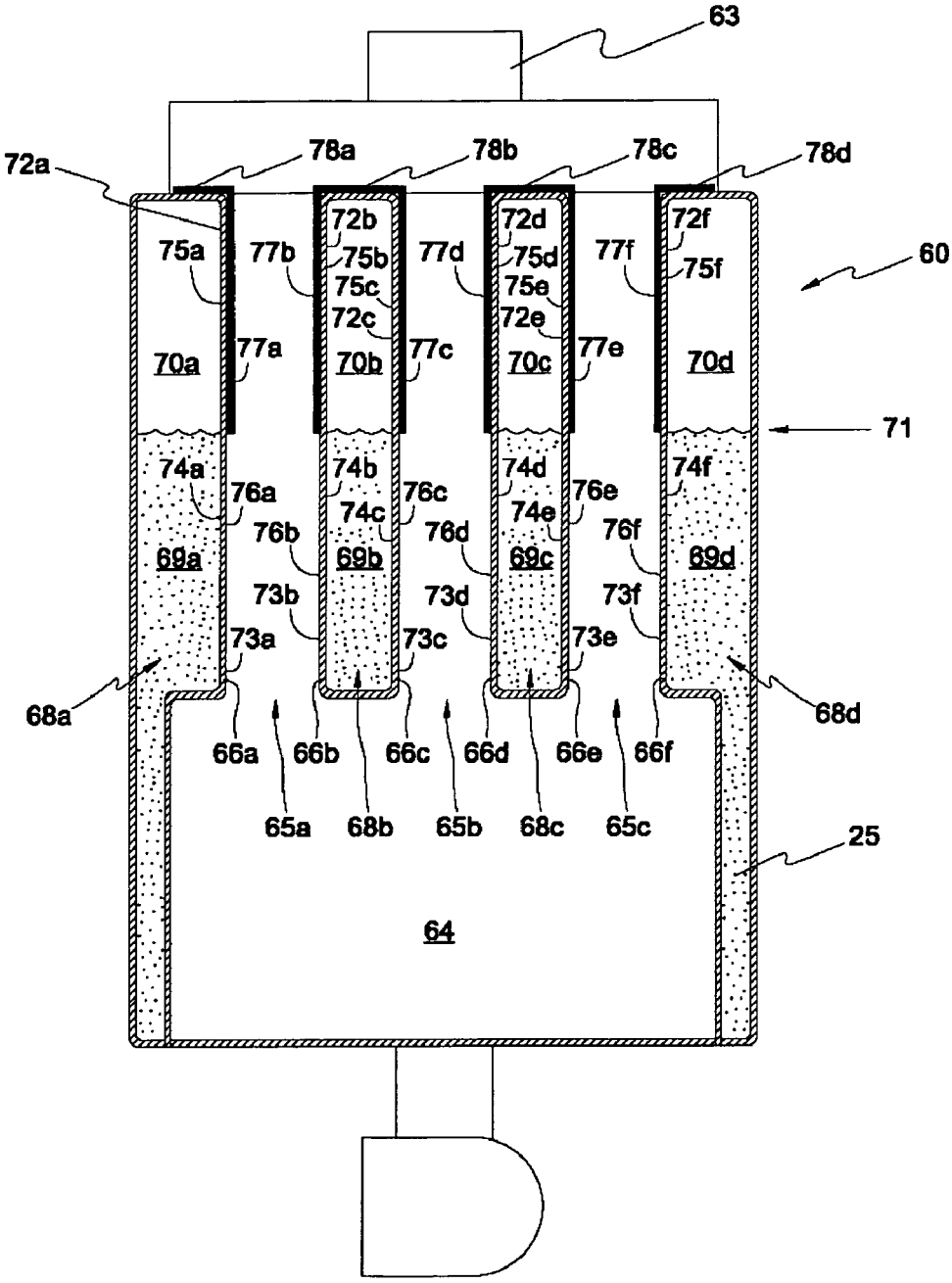
FIG. 9 is a vertical sectional view of the steam boiler shown in FIG. 8, taken generally on line B-B of FIG. 8.

As shown in FIG. 9, the interior volume of heat exchanger 60 is similar to the embodiment of heat exchanger 17 shown in FIG. 5. Combustion chamber 64 is provided beneath three vertically extending flue passages 65*a*-65*c*. Six heat exchange walls 66*a*-66*f* separate multiple interior passages 68*a*-68*d* from flue passages 65*a*-65*c*. As with the previous embodiments, passages 68(*a-d*) comprise a lower water space 69(*a-d*) and a steam space 70(*a-d*), with the water space 69(*a-d*) filled to a waterline 71 with water 25. Heat exchange walls 66*a*-66*f* each have a water side surface 72*a-f* and a gas side surface 73*a-f*. The water side surface has a lower portion 74*a-f* and an upper portion 75*a-f* each of which has a surface area. Each gas side surface 73(*a-f*) has a corresponding lower portion 76(*a-f*) and upper portion 77(*a-f*). In this embodiment, water side surfaces 72*a*-72*f* and passages 68*a*-68*d* are generally the same as the embodiment shown in FIG. 5, and gas side surfaces 73*a*-73*f* and flue passages 65*a*-65*c* are generally the same as the embodiment shown in FIG. 5. Thus, all of gas side surface 73(*a-f*) is a flat vertical surface, and the surface area of lower portion 76(*a-f*) is generally the same as the surface area of upper portion 77(*a-f*). Heat shield 78(*a-d*) covers all of upper portion 77(*a-f*) of gas side surface 73(*a-f*). Again, heat shield 78(*a-d*) decreases heat transfer from combustion gases 19 in passages 65(*a-c*) to upper portion 75(*a-f*) of water side surface 72(*a-f*) of heat exchange walls 66*a*-66*f*. In this embodiment, heat shield 78(*a-d*) is a metal plate that extends over and covers all of upper portion 77(*a-f*) of gas side surface 73(*a-f*) down to waterline 71.

Therefore, while the presently-preferred form of the steam boiler have been shown and described, and several alternative embodiments discussed, persons skilled in this art will readily appreciate that various additional changes and modifications may be made without departing from the spirit of the invention, as defined and differentiated by the following claims.

What is claimed is:

1. A steam boiler comprising:

a fuel burning device disposed in a combustion chamber and adapted to burn a fuel to form combustion gases;

a passage extending between a water inlet and a steam outlet, said passage having a water space and a steam space;

a flue passage extending between said combustion chamber and a flue outlet, said flue passage having a gas heat transfer space;

a heat exchange element between said gas heat transfer space and said water and steam spaces;

said heat exchange element having a gas-side surface that absorbs heat from said combustion gases and an opposed water-side surface that radiates heat;

said water-side surface having a first portion adjacent to said water space and a second portion adjacent to said steam space;

said gas-side surface having a first portion opposite said water-side first portion and a second portion opposite said water-side second portion;

said water-side first portion having a surface area and said water side second portion having a surface area;

said gas-side first portion having a surface area and said gas-side second portion having a surface area; and a heat shield covering at least some of said surface area of said gas-side second portion.

2. The steam boiler set forth in claim 1, wherein said heat shield covers all of said surface area of said gas-side second portion.

3. The steam boiler set forth in claim 1, wherein said heat shield covers some of said surface area of said gas-side first portion.

4. The steam boiler set forth in claim 1, wherein said surface area of said gas-side second portion is less than or approximately equal to said surface area of said water-side second portion.

5. The steam boiler set forth in claim 4, wherein said surface area of said gas-side first portion is greater than said surface area of said water-side first portion.

6. The steam boiler set forth in claim 1, wherein said surface area of said gas-side second portion is greater than said surface area of said water-side second portion and said surface area of said gas-side first portion is greater than said surface area of said water-side first portion.

7. The steam boiler set forth in claim 1, wherein said gas-side first portion comprises a pin deck.

8. The steam boiler set forth in claim 1, wherein said heat exchange element in part of a cast iron section having an interior volume.

9. The steam boiler set forth in claim 8, wherein said interior volume comprises said water space and said steam space.

10. The steam boiler set forth in claim 1, wherein:

said heat exchange element comprises a first cast iron section connected to a second cast iron section;

said first cast iron section and said second cast iron section form a volume there between; and said volume comprises said gas heat transfer space.

11. The steam boiler set forth in claim 10, wherein said first cast iron section has an interior volume and said interior volume comprises said water space and said steam space.

12. The steam boiler set forth in claim 11, wherein said second cast iron section has an interior volume and said interior volume of said second cast iron section comprises a second water space and a second steam space.

13. The steam boiler set forth in claim 1, wherein said heat shield comprises:

a metal plate covering at least some of said surface area of said gas-side second portion; and an air space between said metal plate and at least some of said surface area of said gas-side second portion.

14. The steam boiler set forth in claim 1, wherein said heat shield comprises an insulation layer bonded to at least some of said surface area of said gas-side second portion.

15. The steam boiler set forth in claim 1, wherein said heat exchange element has a ratio between said surface area of said gas-side first portion and said surface area of said water-side first portion of greater than one.

16. The steam boiler set forth in claim 15, wherein said heat exchange element has a ratio between said surface area of said gas-side second portion and said surface area of said water-side second portion that is less than said ratio between said surface area of said gas-side first portion and said surface area of said water-side first portion.

17. A heat exchanger comprising:

a first passage extending between a water inlet and a steam outlet, said first passage having a water space and a steam space;

a second passage extending between a fluid or gas inlet and a fluid or gas outlet, said second passage having a heat transfer space;

a heat exchange element between said heat transfer space and said water and steam spaces;

said heat exchange element having a gas-side surface adapted to absorb heat from said heat transfer space and an opposed water-side surface adapted to radiate heat;

said water-side surface having a first portion adjacent to said water space and a second portion adjacent to said steam space;

said gas-side surface having a first portion opposite said water-side first portion and a second portion opposite said water-side second portion;

said water-side first portion having a surface area and said water side second portion having a surface area;

said gas-side first portion having a surface area and said gas-side second portion having a surface area; and a heat shield covering at least some of said surface area of said gas-side second portion.

* * * * *